US005136972A

United States Patent [19]

Naka et al.

[11] Patent Number: 5,136,972

[45] Date of Patent: Aug. 11, 1992

[54] COATING APPARATUS

[75] Inventors: Hiroyuki Naka, Osaka; Keigo Watanabe, Neyagawa; Masato Mitani; Takashi Ichiyanagi, both of Hirakata, all of Japan

[73] Assignee: Matsushita Electric Industrial Co., Ltd., Kadoma, Japan

[21] Appl. No.: 618,506

[22] Filed: Nov. 28, 1990

[30] Foreign Application Priority Data

Nov. 28, 1989 [JP] Japan ..... 1-308688

[51] Int. Cl.[5] ..... B05C 3/00

[52] U.S. Cl. ..... 118/410; 118/411; 118/419; 118/203; 118/216; 239/104; 239/107; 239/112; 239/117

[58] Field of Search ..... 118/419, 410, 411, 203, 118/302, 216; 239/104, 107, 112, 114, 117, 123; 134/184, 166 R

[56] References Cited

U.S. PATENT DOCUMENTS

| | | | |
|---|---|---|---|
| 1,564,963 | 8/1923 | Kirgan | 239/107 |
| 3,430,643 | 3/1969 | Heiland | 239/107 |
| 3,518,964 | 7/1970 | Nagler | 118/65 |
| 4,143,187 | 3/1979 | Pilgrim et al. | 118/410 |
| 4,172,429 | 10/1979 | Gregorec et al. | 118/302 |
| 4,299,186 | 10/1981 | Pipkin et al. | 118/410 |
| 4,426,023 | 1/1984 | Serry et al. | 239/112 |
| 4,842,900 | 6/1989 | Miyamoto | 118/410 |

FOREIGN PATENT DOCUMENTS

| | | | |
|---|---|---|---|
| 2580198 | 10/1986 | Fed. Rep. of Germany | 134/184 |
| 63-153194 | 6/1988 | Japan . | |

*Primary Examiner*—W. Gary Jones
*Assistant Examiner*—Brenda Lamb
*Attorney, Agent, or Firm*—Wenderoth, Lind & Ponack

[57] ABSTRACT

A coating apparatus includes: a block-shaped die main body; upper and lower nozzle parts projecting from the die main body to form a nozzle, forward end portions of the upper and lower nozzle parts being substantially cylindrical and each of the portions having a constant curvature, the forward end portion of the upper nozzle part serving as a guide, a discharge opening having a slit-shaped sectional configuration being provided in the guide, a bottom surface of which is lower than a surface of the guide; a coating material reservoir, provided in the die main body, communicating with the discharge opening; a groove formed between the upper and lower nozzle parts, through which the discharge opening communicates with the reservoir; a partitioning plate mounted widthwise substantially entirely on one of the forward end portions of the upper and lower nozzle parts so that the partitioning plate is movable through the nozzle to open the groove; a rotary block pivotably supporting the die main body for rotation through a specified angle; and a solvent reservoir, provided below the lower nozzle, for receiving the forward end portions of the nozzle which has moved downward by pivotal motion of the die main body with the rotary block.

8 Claims, 5 Drawing Sheets

COATING APPARATUS

BACKGROUND OF THE INVENTION

The present invention relates to an apparatus for applying coating liquid to a magnetic tape or the like.

One process of applying coating liquid to a magnetic tape is described below as an example. A gravure coating method is a representative example of a technique for uniformly applying coating liquid to a long web as thin as approximately tens of micrometers in a thickness not more than tens of micrometers. According to the gravure coating method, numerous minute concave grooves are formed on the surface of a rotary roll. With the rotation of the rotary roll, a volume of coating material is measured and supplied to the concave grooves so as to continuously transfer the coating material to the web. The coating material is required to coat the magnetic tape in a uniform thickness and the surface of a film formed on the tape is required to be smooth. The maximum coating speed is as slow as 200 m/min to 250 m/min because there is a limit to the speed of the roll which is the speed at which a droplet will be separated from the surface of the rotary roll by centrifugal force. With rationalized mass production in recent years, there is a growing demand for a coating method, for example, capable of reliably carrying out coating and at a speed as fast as not less than 400 /min.

As disclosed in Japanese Laid-Open Patent Publication No. 63-153194, the inventors of the present invention proposed a coating method and an apparatus therefor. The coating apparatus comprises a die for applying a coating solution diluted with a solvent in stripes to a thin web, for example, a magnetic tape in the travel direction, or the longitudinal direction thereof. According to this invention, the edge of the web as well as the entire surface thereof can be favorably coated with the coating solution.

However, the above prior art has some problems in continuously forming a film in a uniform thickness on a magnetic tape or the like if the tape is as long as not less than tens of thousands of meters.

It takes much time and labor for the above prior art to coat the web for the following reason. That is, in the process of carrying out a continuous coating for a long time, coating liquid diluted with a solvent having a high volatility such as methylene group or ethylene group coagulates in the periphery of a discharge opening 15 and the edge surface of a groove 14 as shown by oblique lines in FIG. 7. As a result, the configuration and size of the flow path of the coating material varies as compared with those of the groove 14. When the coating liquid coagulates on a part of a guide 13, the performance of the sliding contact between the web 30 and the guide 13 deteriorates. Consequently, while the web is traveling, it does not locally contact the guide 13. As a result, a film of a uniform thickness cannot be formed on the web 30. In order to overcome such a disadvantage, it is necessary to wash an upper nozzle 12 of the die and a lower nozzle 18 thereof with a solvent after only a short period of use to remove a coagulated substance. In addition, in resuming the coating operation after suspending the operation and replacing the web 30, it is necessary to disassemble the main body 11 and wash out substances which have collected in the discharge opening 15 of the upper nozzle 12 or the groove 21.

SUMMARY OF THE INVENTION

Accordingly, an essential object of the present invention is to provide a coating apparatus for coating a magnetic tape or the like with a coating material reliably, promptly, and continuously over a long time without disassembling and washing a die.

In accomplishing these and other objects, according to the present invention, there is provided a coating apparatus comprising: a block-shaped die main body; upper and lower nozzle parts projecting from the die main body, forward end portions of the upper and lower nozzles being substantially cylindrical and each of the portions having a constant curvature, the forward end portion of the upper nozzle serving as a guide, a discharge opening having a slit-shaped sectional configuration being provided in the guide, a bottom surface of which is lower than a surface of the guide; a coating material reservoir, provided in the die main body, communicating with the discharge opening; a groove formed between the upper and lower nozzles, through which the discharge opening communicates with the reservoir; a partitioning plate mounted widthwise substantially entirely on one of the forward end portions of the upper and lower nozzles so that the partitioning plate is movable through the nozzle to open the groove; a rotary block pivotably supporting the die main body for rotation through a specified angle; and a solvent reservoir, provided below the lower nozzle, for receiving the forward end portions of the nozzles which have moved downward due to pivotal motion of the die main body relative to the rotary block.

According to the above construction, until a coating operation is resumed, the forward end portions of the nozzles are immersed in the solvent reservoir so as to avoid the exposure thereof to air. Thus, the nozzles are not dried. Further, owing to the immersion of the nozzles in the solvent, coating material which has coagulated on the nozzles during the coating operation dissolves in the solvent. This construction allows the coating operation to reliably continue for a long time without disassembling and washing the die main body.

BRIEF DESCRIPTION OF THE DRAWINGS

These and other objects and features of the present invention will become clear from the following description of the preferred embodiments thereof with reference to the accompanying drawings, in which.

DETAILED DESCRIPTION OF THE INVENTION

Figure 1:
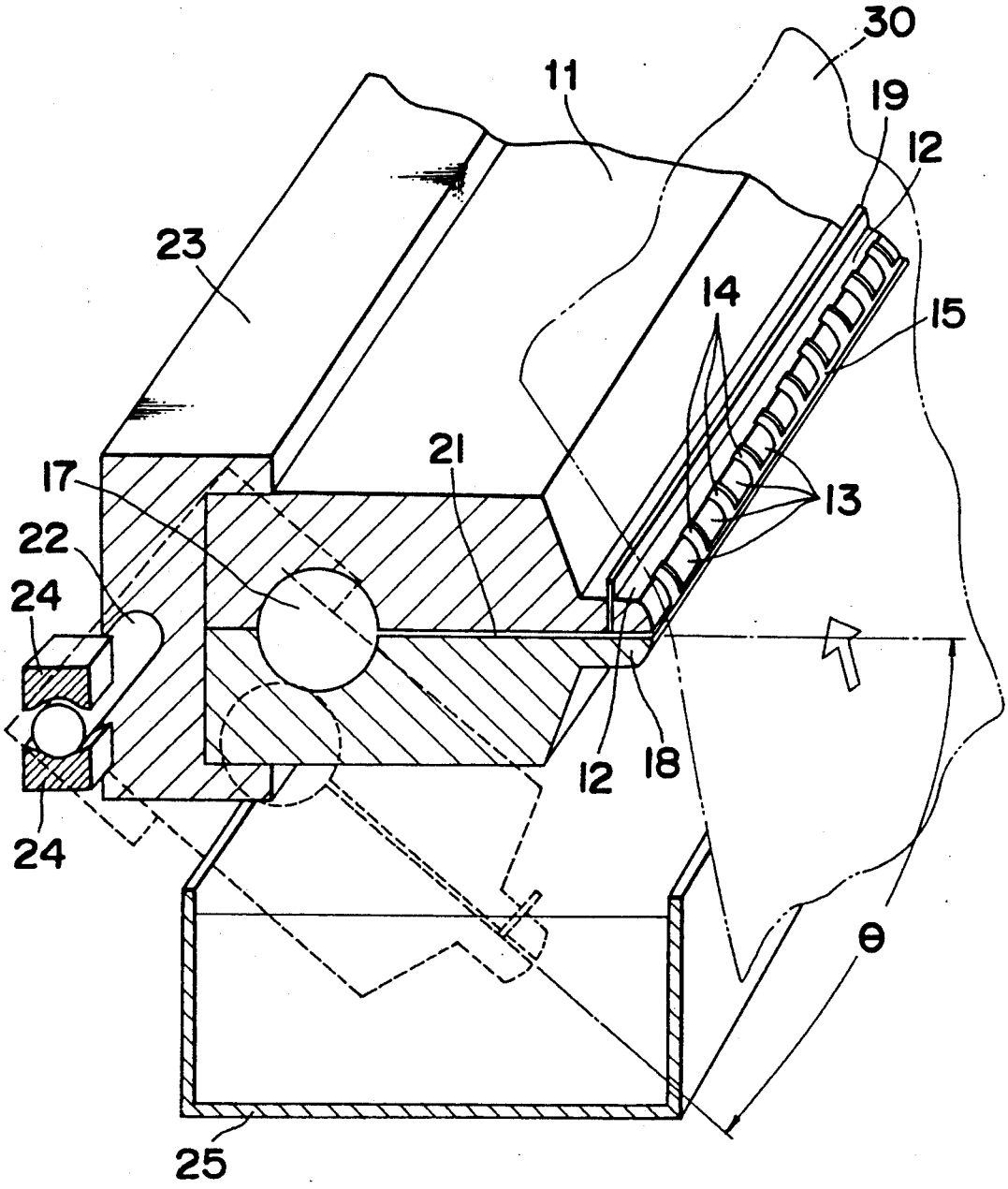
FIG. 1 is a perspective view partly in section showing a coating apparatus according to a first embodiment of the present invention.

Before the description of the present invention proceeds, it is to be noted that like parts are designated by like reference numerals throughout the accompanying drawings.

There is shown in FIG. 1, which is a perspective view partly in section, a coating apparatus according to a first embodiment of the present invention. The apparatus comprises a block-shaped main body 11; a nozzle having an upper nozzle part 12 projecting from the forward portion of the main body 11; and a guide 13, provided on the forward end portion of the upper nozzle part 12, slidably contacted by a web 30, thereby supporting the web 30 travelling in the direction shown by the arrow. It is preferable for the stable travel of the web 30 that the forward end surface of the guide 13 has a constant curvature. The apparatus further comprises a plurality of grooves 14, the inner surface of which is lower than the surface of the guide 13; a discharge opening 15 communicating with a coating material reservoir 17 provided in the main body 11 and out of which the grooves 14 open; a lower nozzle part 18 opposed to the upper nozzle part 12 to form the nozzle and disposed on the upstream side of the travel direction of the web 30, the forward end surface of which is flat or has a cylindrical surface of a small curvature and which is substantially flush with the lower surface of the guide 13. The apparatus further comprises a thin partitioning plate 19 movably inserted into the upper nozzle part 12 in approximately the center of the along protruding direction thereof and along lengthwise direction of the main body 11; a slit-shaped groove 21, with an approximately constant cross sectional area, defined between nozzle parts 12 and 18 and, communicating the coating material reservoir 17 and the discharge opening 15 with each other; and a rotary block 23, having a rotary shaft 22 extending therethrough, supporting the main body 11. The rotary shaft 22 is rotated to pivot the upper and lower nozzle parts 12 and 18 through an angle of $\theta$ with respect to the web 30 so as to move the nozzle parts away from the web 30. The rotary shaft 22 is supported by a shaft supporting mechanism 24. The apparatus further comprises a solvent tank 25 containing a solvent and positioned below nozzle parts 12 and 18. The upper and lower nozzle parts 12 and 18 are rotated through the angle of $\theta$ so as to be immersed in the solvent in the solvent tank 25.

The operation of the apparatus having the above construction is described in detail below. In the normal operation for applying the coating material to the web 30 in stripes, the partitioning plate 19 is fixed to the upper nozzle part 12 at a level out to the groove 21 in order not to prevent the flow of the coating material contained in the coating material reservoir 17 through the discharge opening 15. After the coating operation has been performed for a certain period, when the replacement of the web 30 necessitates the suspension of the coating operation, the partitioning wall 19 is moved downward until it contacts the lower nozzle 18 to interrupt the supply of the coating material. Then, the main body 11 sandwiched by the rotary block 23 is rotated through the angle $\theta$ about the rotary shaft 22 to immerse the upper and lower nozzle parts 12 and 18 in the solvent in the solvent tank 25. The upper and lower nozzle parts 12 and 18 are kept immersed in the solvent tank 25 until the coating operation is resumed. Neither the upper nozzle 12 nor the lower nozzle part 18 are allowed to remain exposted to air for any great length of time. Therefore, coating material which covers the upper and lower nozzle parts 12 and 18 is prevented from coagulating. The coating material which has coagulated on the upper and lower nozzle parts 12 and 18 in the coating operation dissolves in the solvent. For resuming the coating operation, the rotary block 23 is pivoted back to the original position, the partitioning plate 19 is moved upward to the predetermined position in order not to prevent the flow of the coating material through the groove 21, and the web 30 is caused to travel upward, resulting in immediate start of the coating operation. In the first embodiment, the guide 13 is provided on the upper nozzle part 12 to apply the coating material to the web 30 in stripes; however, a similar effect can also be obtained by omitting guide 13 from the upper nozzle part 12 and applying the coating material to the web 30 from a flat surface. The partitioning plate 19 can be provided in the lower nozzle part 18 rather than in the upper nozzle part 12.

Figure 2:
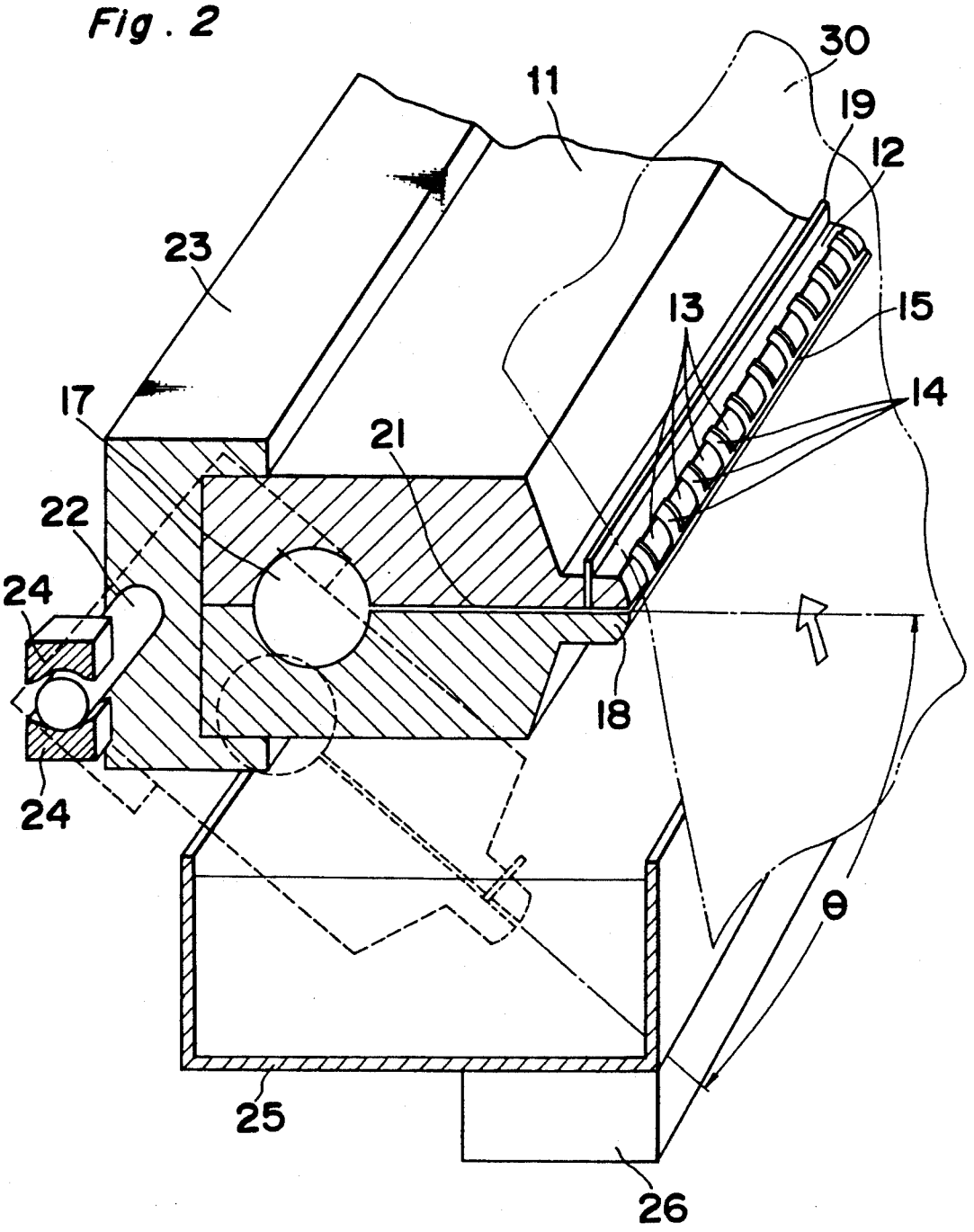
FIG. 2 is a perspective view partly in section showing a coating apparatus according to a second embodiment.

A second embodiment of the present invention will be described below with reference to FIG. 2 which is a perspective view partly in section of a coating apparatus according to the second embodiment. In this embodiment, an ultrasonic wave generating device 26 is attached to the solvent tank 25. When the upper nozzle part 12 and the lower nozzle part 18 are immersed in the solvent tank 25, the ultrasonic wave generating device 26 agitates the solvent. Therefore, the coating material which has coagulated on the upper and, lower nozzle parts 12 and 18 can be effectively washed off in a short period of time. The oscillation frequency of the ultrasonic wave generating device 26 can be varied to an optimum condition depending on the kind of coating material and solvent.

Figure 3:
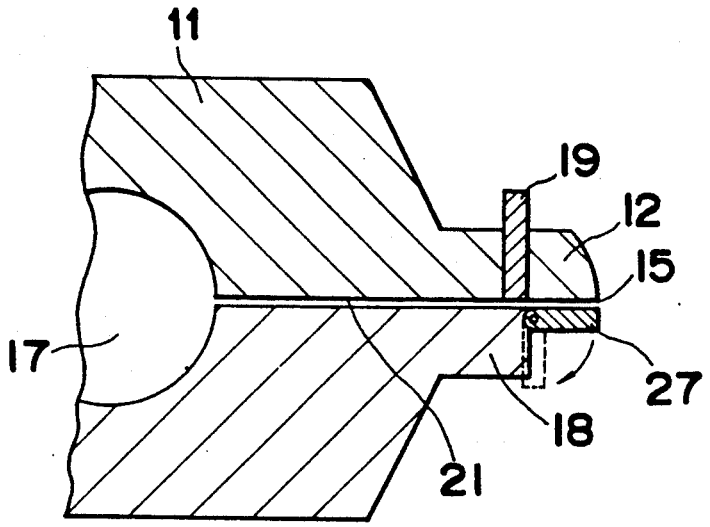
FIG. 3 is a sectional elevation showing the discharge opening of a coating apparatus according to a third embodiment.

A third embodiment of the present invention will be described below with reference to FIG. 3 which is a sectional elevation showing the discharge opening 15 of a coating apparatus according to the third embodiment. The third embodiment is different from the first embodiment in that the forward end surface of the lower nozzle part 18 comprises a lip 27 rotatable clockwise approximately 90°. In a normal coating condition, the end or outer surface of the lip 27 and the outer surface of the lower nozzle part 18 are flush with each other. There is a space serving as the groove 15 of a constant cross sectional area between the lower surface of the upper nozzle part 12 and the upper surfaces of both the lower nozzle part 18 and the lip 27, the lower surface of the upper nozzle part 12 and the upper surfaces of the lower nozzle part 18 and the lip 27 being parallel with each other. The partitioning plate 19 is fixed to the upper nozzle 12 at a level out of the groove 21 so as not to prevent the flow of the coating material through the groove 21. The forward end surfaces of the lip 27 and the upper nozzle part 12 are substantially flush with each other. It is necessary to position the pivotal axis of the lip 27 downstream from the partitioning plate 19 along the flow of the coating material. When the upper and lower nozzle parts 12 and 18 are washed, the partitioning plate 19 is moved downward until it contacts the upper surface of the lower nozzle 18 under pressure to interrupt the coating material and flowing through the groove 21, and then the lip 27 is pivoted approximately 90° clockwise. Thus, the lower surface of the upper nozzle part 12 serving as the surface defining groove 21 can be washed. This structure can permit quick removal of foreign matter such as dust on the web 30 which has penetrated from the web 30 into the groove 21 so that the discharge opening 15 is clogged with the dust during the coating operation or bubbles which have penetrated in the coating material so that the discharge opening 15 is clogged with the bubbles during the coating operation. The effect which can be obtained by using the solvent tank is similar to the first embodiment.

Figure 4:
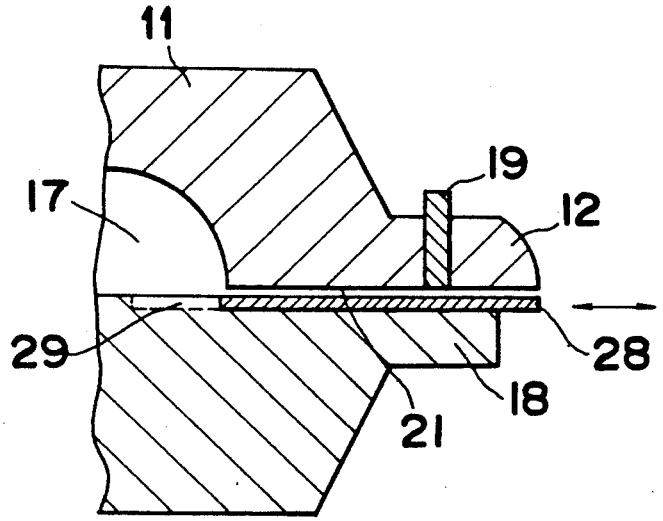
FIG. 4 is a sectional elevation showing the discharge opening of a coating apparatus according to a fourth embodiment.

A fourth embodiment of the present invention will be described below with reference to FIG. 4 which is a sectional elevation showing the discharge opening 15 of a coating apparatus according to the fourth embodiment. The fourth embodiment is different from the first embodiment in that the coating apparatus includes a flat plate 28 mounted on the lower nozzle part 18 opposed to the upper nozzle part 12. The flat plate 28 slidably moves backward or forward in a plate holding groove 29. Preferably, the length of the plate 28 extends from the coating material reservoir 17 to the position corresponding to the forward end of the upper nozzle part 12. In a normal coating operation, the flat plate 28 operates as a part of the lower nozzle part 18, thus determining the cross sectional area of the groove 21 formed between the upper and lower nozzle parts 12 and 18. When foreign matter or bubbles have penetrated into the coating material during the coating operation, the partitioning plate 19 is moved downward to close the groove 21, and the flat plate 28 is then moved backward or forward through the plate holding groove 29 to clean the groove 21. More specifically, when the flat plate 28 is moved forward, the surface of the groove 21 on the lower nozzle part side is exposed. When the flat plate 28 is moved backward, namely, toward the coating material reservoir 17, the surface of the groove 21 on the upper nozzle part side is exposed. In this manner, the foreign matter disposed on the surface of the upper and lower nozzle parts 12 and 18 can be promptly removed without disassembling the main body 11 of the die. The effect which can be obtained by the provision of the solvent tank not shown is similar to that of the first embodiment.

Figure 5:
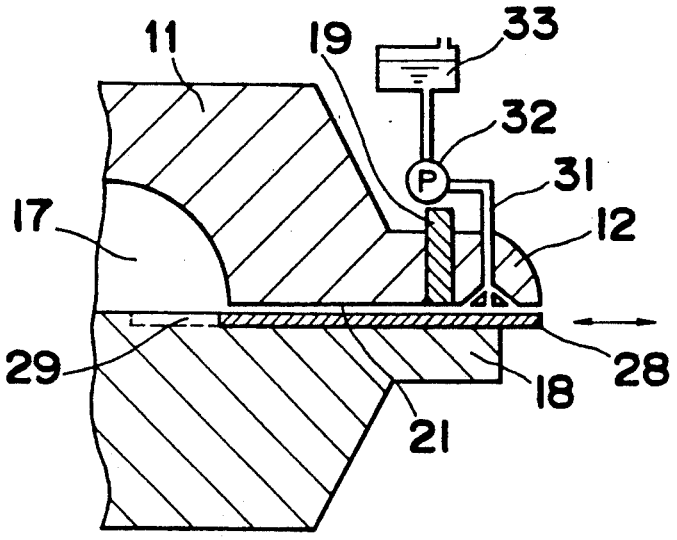
FIG. 5 is a sectional elevation showing the discharge opening of a coating apparatus according to a fifth embodiment.

A fifth embodiment of the present invention will be described below with reference to FIG. 5 which is a sectional elevation showing the discharge opening 15 of a coating apparatus according to the fifth embodiment. The fifth embodiment is different from the fourth embodiment in that the coating apparatus includes a pipe system 31 branching off, at a portion in the vicinity of the front portion of the upper nozzle part 12, into a plurality of pipes communicating with the groove 21; a pump 32, communicating with the pipe system 31, for supplying a constant amount of solvent to the pipe system 31; and a solvent storing tank 33 for supplying the solvent to the pump 32. When it is necessary to wash the groove 21, the pump 32 is driven. As a result, the solvent stored in the solvent storing tank 33 is jetted from the lower wall of the upper nozzle part 12 to the upper wall of the lower nozzle part 18 through the pipe system 31. Since the gap of the groove 21 is not more than 1 mm, the jetted coating material collides the upper wall of the lower nozzle part 18, thus generating a turbulent flow. Thus, the lower wall of the upper nozzle part 12 is washed as well. Portions which cannot be cleaned with hands, for example, the corners of the groove 21 can be washed by the solvent in a short period of time. Therefore, fiber waste from cloth which is conventionally used in cleaning with hands does not collect in the groove 21. Further, the provision of the pipe for the jet cleaning eliminates the need for disassembling the main body 11 of the die.

Figure 6:
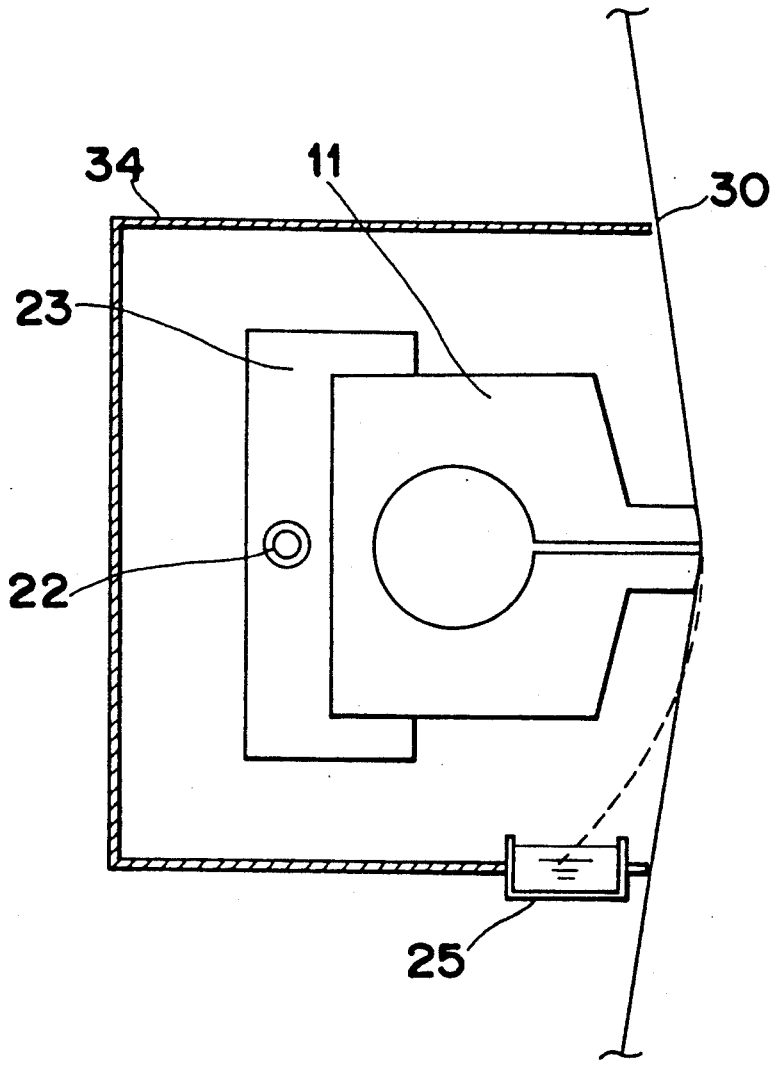
FIG. 6 is a schematic sectional view showing a coating apparatus according to a sixth embodiment.
Figure 7:
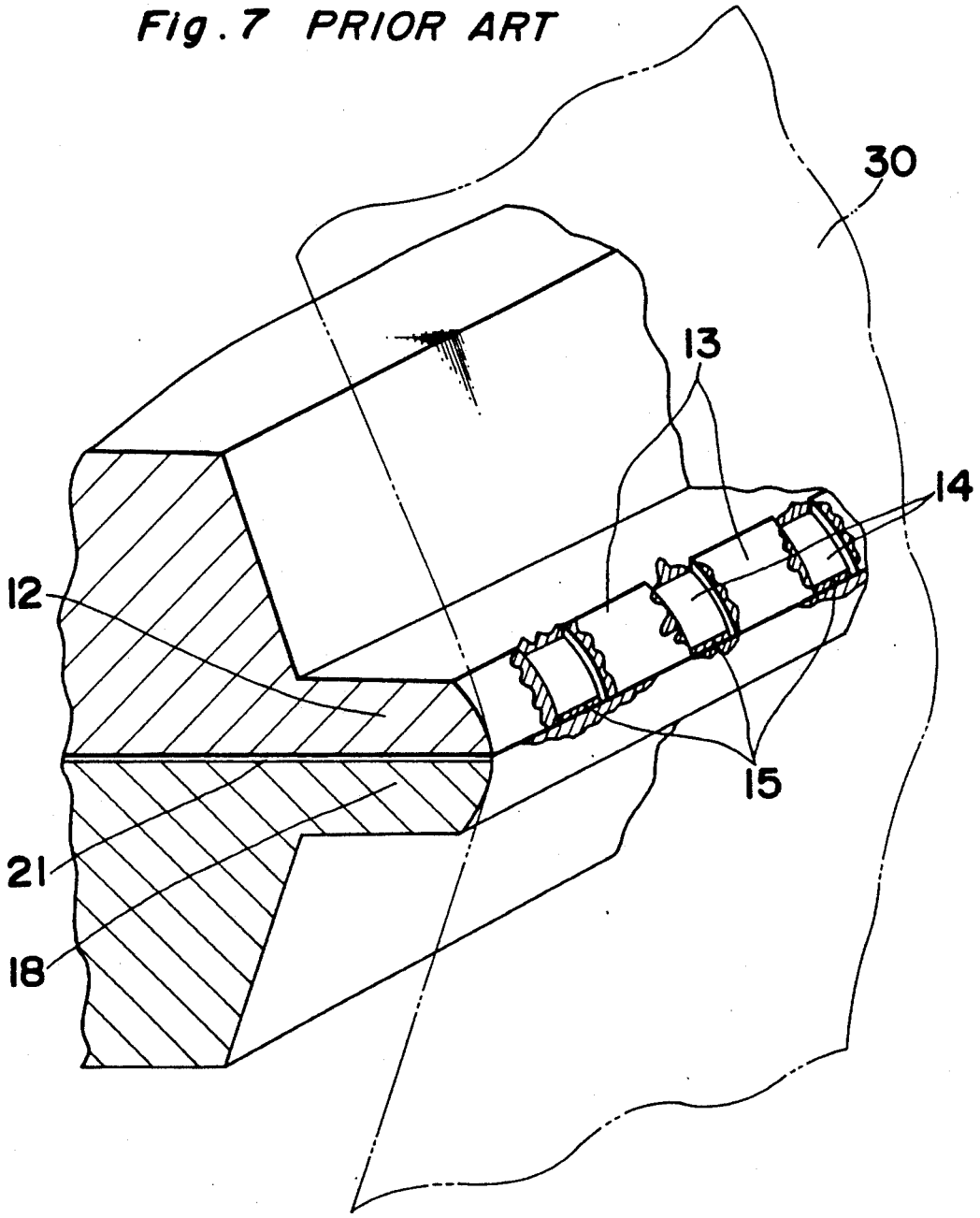
Fig. 7 PRIOR ART
FIG. 7 is a perspective view partly in section showing an unfavorable condition of the forward end portion of a conventional die.

A sixth embodiment of the present invention will be described below with reference to FIG. 6 which is a cross-sectional view of a coating apparatus according to the sixth embodiment. The sixth embodiment is different from the first through fifth embodiments in that the main body 11 and the solvent tank 25 are enclosed in a casing 34 of a substantially rectangular cross-sectional shape so that the casing 34 can be filled with gas vaporized from the solvent contained in the solvent tank 25. Referring to FIG. 6 showing the cross section of the casing 34, only the side of the main body 11 over which the web 30 travels is exposed to the outside. Preferably, the gap between the casing 34 and the web 30 is small for preventing the leakage of gas which has vaporized from the solvent from the casing 34. But in order to avoid the contact of the casing 34 and the web 30, the gap is set to as small as 1 mm to 0.1 mm. However, on the upstream side in the travel direction of the web 30, the casing 34 and the web 30 are allowed to contact each other. In the above construction, the web 30 is permitted to contact the forward end surface of the main body 11. Inside the casing 34, the gas vaporized from the solvent in the solvent tank 25 is set to have a high pressure. Therefore, the coagulation of the coating material can be greatly reduced. Thus, the number of times the coagulated coating material must be washed off can be reduced.

The solvent for filling the casing 34 can be supplied from a solvent container positioned at a different place. To this end, it is possible to fill the casing 34 with gas vaporized from the coating material coating on the web 30 during the coating operation.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A coating apparatus comprising:

a block-shaped die main body;

upper and lower nozzle parts projecting from said die main body, forward end portions of said upper and lower nozzle parts being smoothly curved, the forward end portion of the upper nozzle part serving as a guide surface for a sheet to be coated;

a coating material reservoir in said die main body;

said upper and lower nozzle parts being spaced from each other to define between them a groove from said coating material reservoir to said forward ends of said nozzle parts and opening out from between said nozzle parts in a discharge slit;

a partitioning plate mounted widthwise substantially entirely on the forward end portion of one of the upper and lower nozzle parts and reciprocally movable through said one nozzle part from a position fully blocking said groove to a position in which said groove is fully open;

a rotary block on which said die main body is mounted and rotatable from a position in which said guide surface is engagable by the sheet to be coated and through a predetermined angle to a solvent immersed position; and a solvent reservoir below said lower nozzle part into which the forward end portions of said nozzle parts are moved in said solvent immersed position, whereby when a solvent is provided in said solvent reservoir, said nozzle parts are immersed in the solvent in the solvent immersed position.

2. A coating apparatus as claimed in claim 1 in which said forward end portions of said nozzle parts are substantially cylindrical and each has a constant curvature.

3. A coating apparatus as claimed in claim 1 further comprising an ultrasonic wave generating device mounted on said solvent reservoir for supplying a predetermined intensity of ultrasonic wave energy to a solvent contained in said solvent reservoir.

4. A coating apparatus as claimed in claim 1 wherein the forward end portion of said lower nozzle part has a plate-shaped lip pivotally mounted thereon about a pivot axis for pivotal movement through about 90° away from said upper nozzle part, and said pivot axis is downstream, in the direction of coating material flow through said groove, from the position of said partitioning plate.

5. A coating apparatus as claimed in claim 1 wherein said lower nozzle part has a flat plate holding groove at the forward end portion thereof in a surface opposed to said upper nozzle part and defining part of said groove, and a flat plate in said flat plate holding groove slidably movable in the direction of the length of said groove.

6. A coating apparatus as claimed in claim 5 further comprising a plurality of passages through said upper nozzle part opening into said groove toward said lower nozzle part, a solvent pump connected to said passages, and a solvent storage tank connected to said pump.

7. A coating apparatus as claimed in claim 1 further comprising a plurality of passages through said upper nozzle part opening into said groove toward said lower nozzle part, a solvent pump connected to said passages, and a solvent storage tank connected to said pump.

8. A coating apparatus as claimed in claim 1 further comprising a substantially rectangular cross-section casing around said die main body, said nozzle parts and said solvent reservoir and said casing having an open side opening in the direction of the forward ends of said nozzle parts and adapted to be closed off by the sheet to be coated passing over said nozzle parts.

* * * * *